US011214982B2

(12) United States Patent
Raatikainen

(10) Patent No.: US 11,214,982 B2
(45) Date of Patent: Jan. 4, 2022

(54) LOCK BODY

(71) Applicant: ABLOY OY, Joensuu (FI)

(72) Inventor: Juha Raatikainen, Kontiolahti (FI)

(73) Assignee: ABLOY OY, Joensuu (FI)

( * ) Notice: Subject to any disclaimer, the term of this patent is extended or adjusted under 35 U.S.C. 154(b) by 944 days.

(21) Appl. No.: 15/760,903

(22) PCT Filed: Sep. 6, 2016

(86) PCT No.: PCT/FI2016/050616

§ 371 (c)(1),
(2) Date: Mar. 16, 2018

(87) PCT Pub. No.: WO2017/046445

PCT Pub. Date: Mar. 23, 2017

(65) Prior Publication Data

US 2018/0274264 A1 Sep. 27, 2018

(30) Foreign Application Priority Data

Sep. 18, 2015 (FI) ..... 20155670

(51) Int. Cl.

| | |
|---|---|
| ***E05B 15/10*** | (2006.01) |
| ***E05B 15/04*** | (2006.01) |
| ***E05B 65/10*** | (2006.01) |
| ***E05B 53/00*** | (2006.01) |
| ***E05B 55/00*** | (2006.01) |

(Continued)

(52) U.S. Cl.

CPC ..... *E05B 15/101* (2013.01); *E05B 15/04* (2013.01); *E05B 53/00* (2013.01); *E05B 55/00* (2013.01); *E05B 65/1086* (2013.01); *E05C 1/12* (2013.01); *E05B 2015/0437* (2013.01);

(Continued)

(58) Field of Classification Search

CPC ..... Y10T 292/0969; Y10T 292/0971; Y10T 292/0977; Y10T 292/0999; E05B 2015/0437; E05B 63/08; E05B 63/16; E05B 63/18; E05B 65/1086; E05B 15/04; E05B 15/101; E05B 2015/0403; E05B 2015/0406; E05B 2015/0413; E05B 2015/0496; E05B 55/00; E05B 53/00; E05C 1/12

See application file for complete search history.

(56) References Cited

U.S. PATENT DOCUMENTS 778,469 A * 12/1904 Uhri ..... E05C 7/06 292/177
1,203,394 A * 10/1916 Ottinger ..... E05C 7/06 292/177

(Continued)

FOREIGN PATENT DOCUMENTS

CN 2813811 Y 9/2006
CN 101432496 A 5/2009

(Continued)

*Primary Examiner* — Carlos Lugo
(74) *Attorney, Agent, or Firm* — Muncy, Geissler, Olds and Lowe, P.C.

(57) ABSTRACT

The parts forming the force transmission connection from the spindle shaft of the handle of the lock body to the bolt include a spring, which is also arranged to transfer force. The spring is used to eliminate the protrusion of the bolt caused by tolerance variations, when the handle installed into the lock body is turned to its extreme position to open the door.

6 Claims, 5 Drawing Sheets

Figure 1:
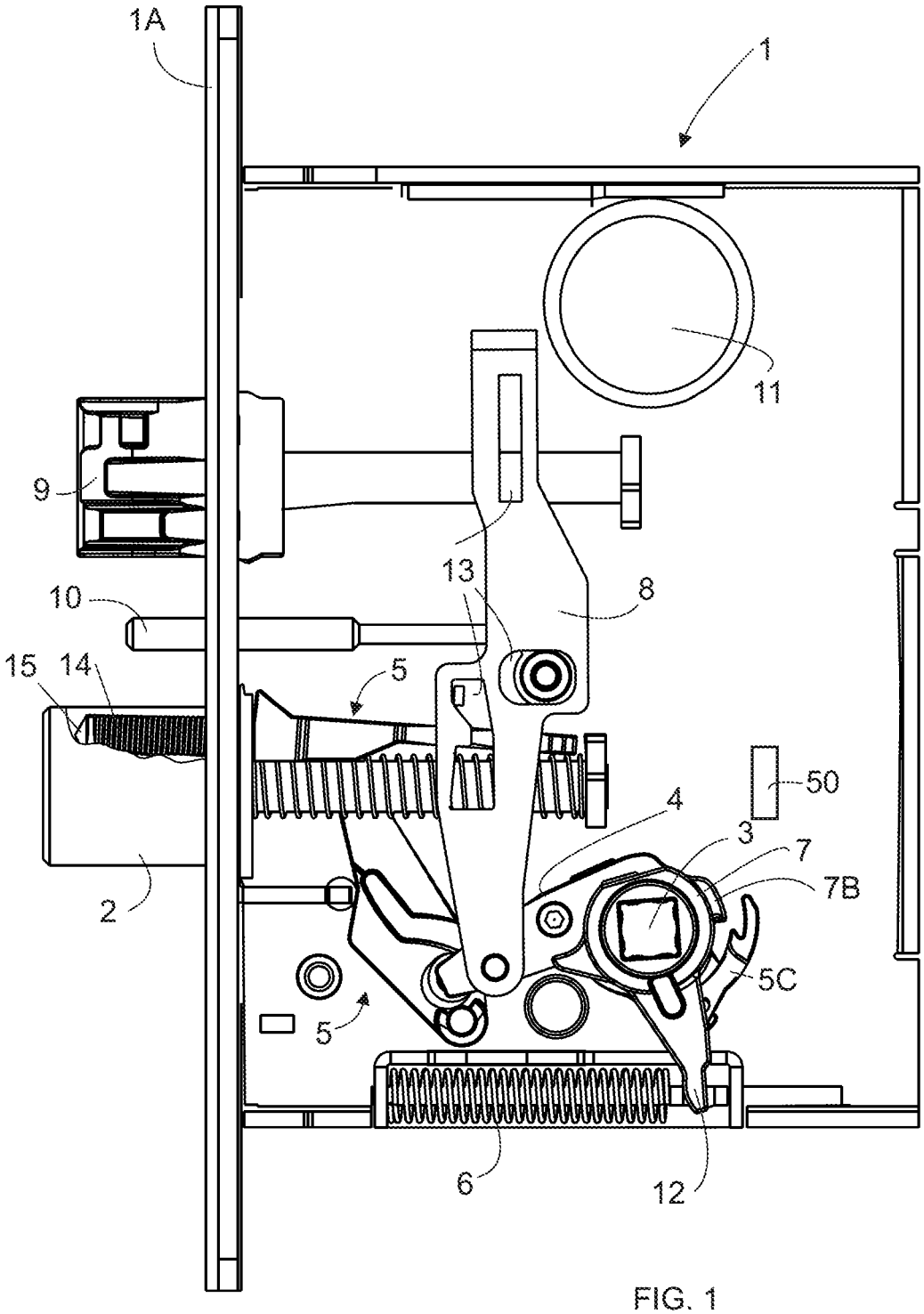

(51) Int. Cl.
*E05C 1/12* (2006.01)
*E05B 15/00* (2006.01)

(52) U.S. Cl.
CPC .... *Y10T 292/0969* (2015.04); *Y10T 292/0977* (2015.04); *Y10T 292/0999* (2015.04)

(56) References Cited

U.S. PATENT DOCUMENTS 2,217,131 A * 10/1940 Nilsson ..... E05B 15/04 292/140
3,750,433 A * 8/1973 Sanders ..... E05B 63/16 70/486
3,917,329 A * 11/1975 Fujiki ..... E05B 55/00 292/163
4,183,565 A * 1/1980 Allemann ..... E05B 65/104 292/150
4,589,691 A * 5/1986 Foshee ..... E05B 63/16 292/150
6,260,392 B1 * 7/2001 Geiger ..... E05B 47/0607 70/276
6,651,466 B1 11/2003 Shih
6,851,287 B1 2/2005 Yang
6,978,646 B2 * 12/2005 Raatikainen ..... E05B 47/0688 70/472
9,790,708 B2 * 10/2017 Clark ..... E05C 1/06
2012/0139267 A1 * 6/2012 Chen ..... E05B 53/00 292/56
2016/0281391 A1 * 9/2016 Bartholdi ..... E05B 63/20

FOREIGN PATENT DOCUMENTS

CN 201924657 U 8/2011
CN 202000774 U 10/2011
CN 103670049 A 3/2014
EP 2016243 B1 10/2009
EP 2677098 A1 * 12/2013 ..... E05B 15/101
EP 2682544 A1 * 1/2014 ..... E05B 63/0065
EP 2706174 A2 3/2014
FR 2242549 A1 3/1975
GB 191405354 A * 3/1915 ..... E05B 47/0002
GB 2151692 A 7/1985
GB 2199612 A 7/1988
JP 2007169880 A 7/2007
NL 7411534 A 3/1975
NZ 20010530718 A 8/2008
WO WO-2008031528 A2 * 3/2008 ..... E05B 47/0046
WO WO-2015010670 A1 * 1/2015 ..... E05B 63/0069

* cited by examiner

LOCK BODY

TECHNICAL FIELD

The invention relates to a lock body having a bolt. The bolt is arranged to move linearly into the protruded position, in which it locks the door, into which the lock body is installed. The bolt is also to be moved by a linear movement inside the lock body such that the door is to be opened.

PRIOR ART

In known lock bodies, many parts are generally used to transfer to the bolt a turning force applied to the handle of the lock body, in order that the bolt can be moved by a linear movement inside the lock body. There are clearances in between each of the parts and tolerance variations in the parts. Because the retraction of the bolt to open the door is thus realized by means of the cooperation of many parts, clearance and tolerance variations can create a chain such that the end of the bolt can remain somewhat protruded from the surface of the face plate. The protrusion of the bolt in relation to the face plate can be as much as 4-5 mm. This can prevent or hinder opening of the door.

In order that the lock body can be made to work reliably, the parts of the lock body must be manufactured with extreme care and the investment in quality control must be relatively substantial. These factors also affect lock body expenses.

BRIEF DESCRIPTION OF THE INVENTION

The object of the invention is to obviate the above said disadvantages of prior known art. This is achieved in the manner described in the independent claim. The dependent claims describe preferred embodiments of the invention.

The invention is based on the idea that the parts forming the force transmission connection from the spindle shaft of the handle to the bolt comprise a spring, which is also arranged to transfer force. Using the spring, it is possible to eliminate the protrusion of the bolt caused by the clearances and tolerance variations, when the handle is turned to its extreme turning position to open the door.

A lock body according to the invention comprises a body, into which is positioned a bolt, a spindle shaft of the handle, a follower positioned pivotally on the spindle shaft of the handle, and a force transmission linkage 5 to transfer a turning force applied to the spindle shaft of the handle through the follower 4 to the bolt 2 to move it linearly inside the lock body. The force transmission linkage 5 further comprises a biased spring 14, through which a turning force applied to the spindle shaft of the handle 3 is arranged to transfer to the bolt 2. The spring is arranged to bias further if the bolt 2 is moved inside the lock body and there remains travel distance of the follower 4 towards the pivoted position of the follower. The lock body further comprises a limiter part 50 to limit the linear movement of the bolt inside the lock body.

LIST OF FIGURES

Figure 2:
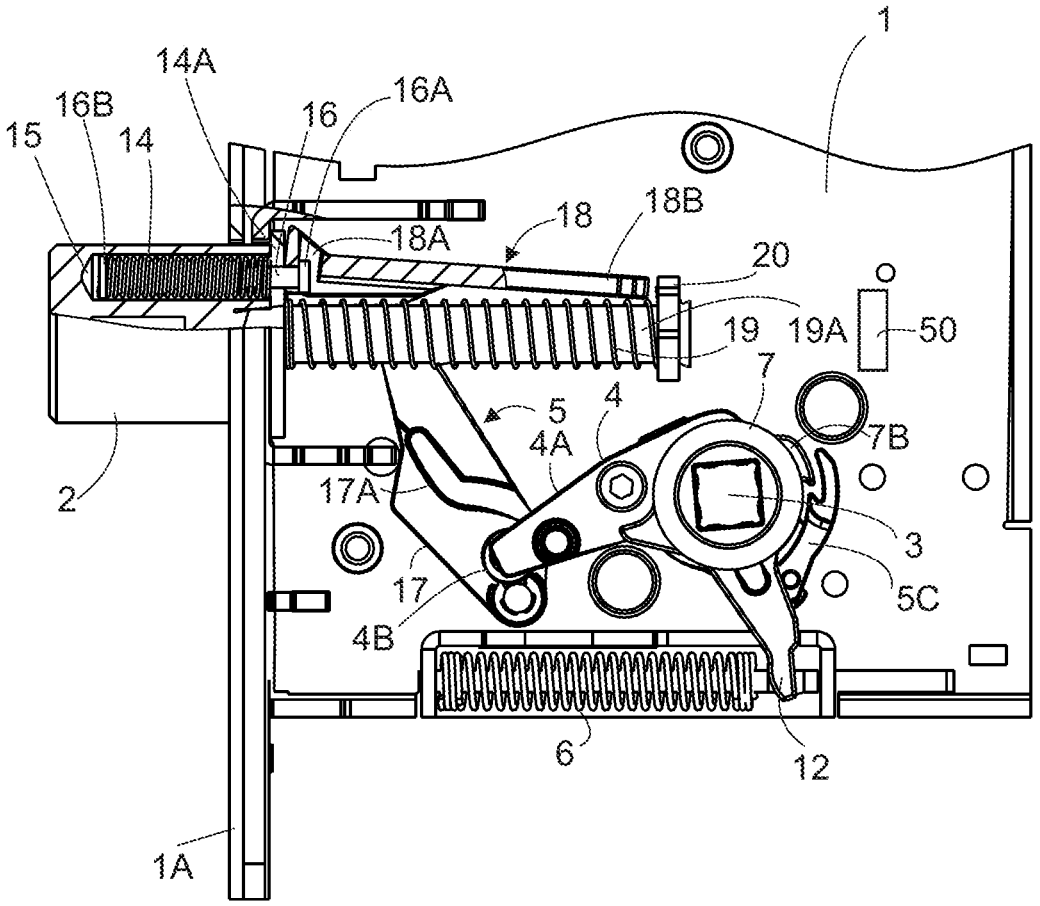
Figure 3:
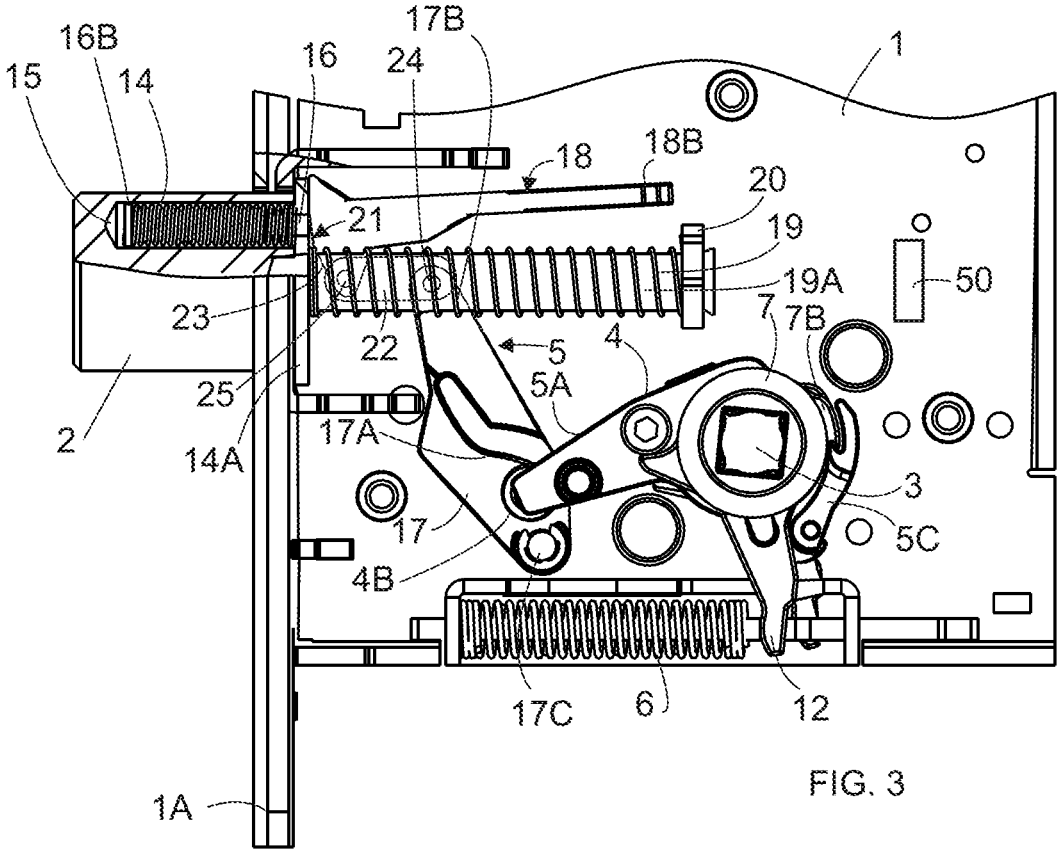
Figure 4:
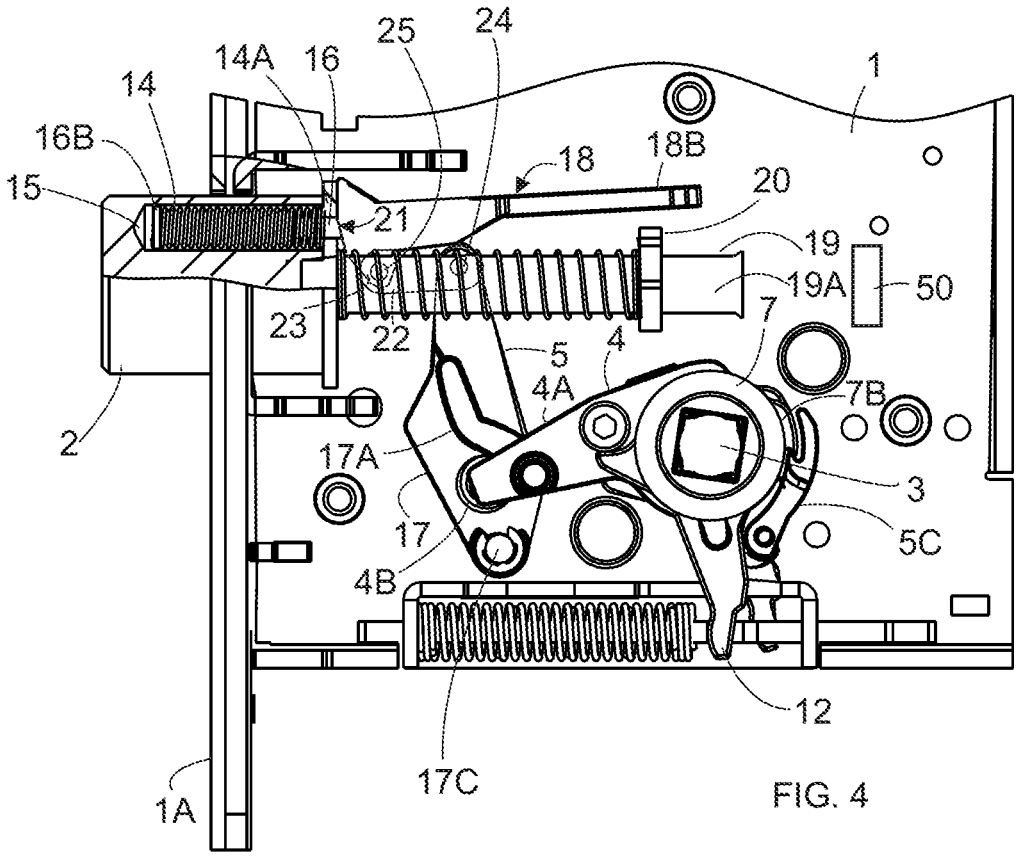
Figure 5:
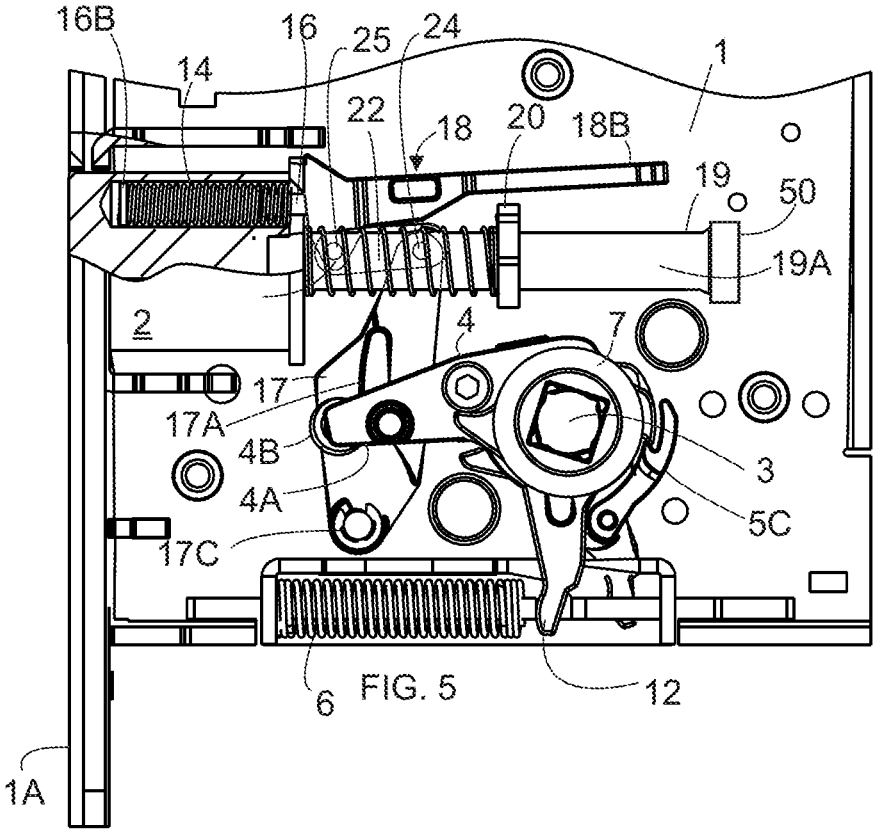
Figure 6:
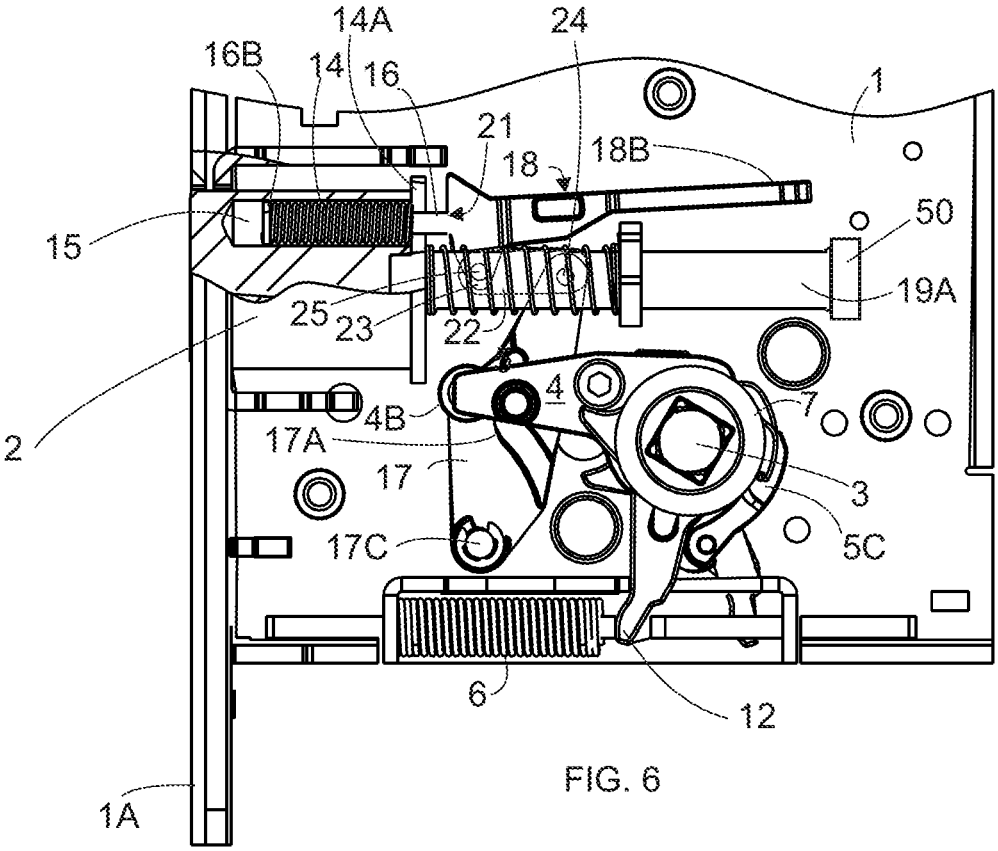
Figure 7:
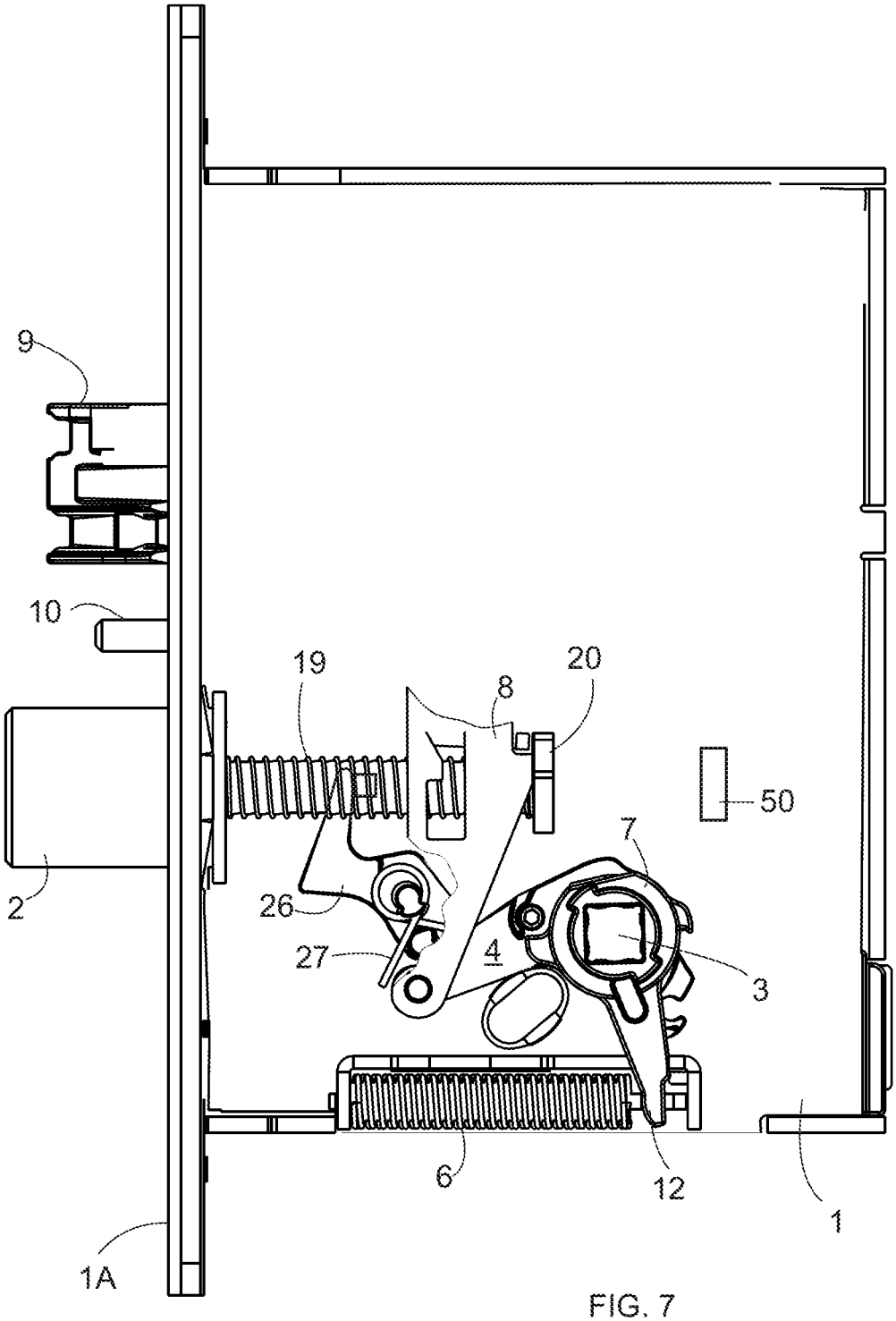

In the following, the invention is described in more detail by means of the accompanying figures, in which FIG. 1 shows an example of a lock body according to the invention, FIG. 2 shows an example of a lock body according to the invention with the bolt protruded, FIG. 3 shows the example of FIG. 2 with the bolt protruded and the handle slightly turned, FIG. 4 shows the example of FIG. 2 of the lock body according to the invention with the bolt partially moved inside the lock body, FIG. 5 shows the example of FIG. 2 of the lock body according to the invention with the bolt moved inside the lock body, FIG. 6 shows the example of FIG. 2 of the lock body according to the invention with the bolt moved inside the lock body and the spring further biased, and FIG. 7 shows yet another example of a lock body according to the invention with the bolt protruded.

DESCRIPTION OF THE INVENTION

FIG. 1 shows an example of a lock body according to the invention comprising a body 1, into which is positioned a bolt 2, a spindle shaft 3 of the handle, a follower 4 positioned pivotally on the spindle shaft 3 of the handle, and a force transmission linkage 5 to transfer a turning force applied to the spindle shaft of the handle through the follower 4 to the bolt 2 to move it linearly inside the lock body. The spindle shaft 3 of the handle is the location, on which can be positioned a spindle and the handle in connection with it for pivoting the follower 4. It is also quite common that in connection with the spindle shaft 3 of the handle is installed a driver 7, which can be engaged into a force transmission connection with the follower or disengaged from said force transmission connection. Connection can be realized, for example, by a clasp 5C, which is to be controlled by a solenoid (not shown in the figures). The driver is either on one side or on both sides of the follower.

The handle and the spindle shaft of the handle are in the basic position, when there is no turning force applied to them from the handle to open the locking of the lock body, in order that the door can be opened. In this case, the bolt 2 is protruded in the manner shown in FIG. 1. The lock body generally has a retaining spring 6, which is intended to push the follower 4 towards the basic position. The follower thus comprises a projection 12, which abuts the retaining spring.

The force transmission linkage 5 further comprises a biased spring 14, through which a turning force applied to the spindle shaft 3 of the handle is arranged to transfer to the bolt 2. The spring is arranged to bias further if the bolt 2 is moved inside the lock body and there remains travel distance of the follower 4 towards the pivoted position of the follower. The pivoted position of the follower means the position, in which the handle and thus also the spindle of the handle, its axis and the follower are pivoted into the extreme position, i.e. as much as possible, to move the bolt inside the lock body. FIG. 1 also shows the limiter part 50, which limits the linear movement of the bolt inside the lock body.

As can be observed from FIG. 1, the lock body can further comprise other parts, such as a location 11 for the lock cylinder, a light bolt 9, a control wedge 10 and a draw plate 8. The draw plate has control openings 13. These and other parts, which are not shown in the figures, are not related to the invention, thus they are not described in more detail in this connection.

In the example of FIG. 1, the spring 14 is positioned into a borehole 15 in the bolt, thus the spring 14 is between the bolt 2 and the force transmission linkage 5. The spring can also be positioned at some other point in the force transmission linkage 5. It can be positioned, for example, between the follower 4 and the force transmission linkage 5. FIG. 7 shows such a positioning point of the spring 27 in another embodiment of the invention. The force transmission linkage of FIG. 7 has a pivoting arm 26 to transmit force to the bolt 2. It can be observed that the force transmission linkage 5, 26 can also be implemented in various ways.

FIG. 2 shows an example of a lock body according to the invention with the bolt protruded, in which the follower 4 is in the basic position. As has already been stated, the bolt 2 comprises a borehole 15, into which the spring 14 is positioned. The spring is a coil spring, and into the borehole is also partially positioned a pin 16 surrounded by the spring 14.

The first end of the pin 16 has an outer flange 16B, and the pin is part of the force transmission linkage 5, and the outer flange 16B of its first end is in connection with the first end of the spring. The other end of the spring 14 abuts the rear part 14A of the bolt. The other end of the pin is in a force transmission connection with the rest of the force transmission linkage 5. The other end of the pin 16 can also have an outer flange 16A, which is arranged into a force transmission connection with the rest of the force transmission linkage 5.

The force transmission linkage 5 of the embodiment of FIG. 2 comprises a rocker arm 18, which is in a force transmission connection with the outer flange 16A of the other end of the pin 16, and which rocker arm has a space 18A for the outer flange of the other end. The rocker arm is arranged to pivot, when the follower 4 moves away from the basic position. In other words, when one begins to turn the handle from the basic position towards the pivoted position, the rocker arm pivots. In the figures, partial sections are used, in order that the features of the invention may be seen more clearly. From FIG. 2 is seen, for example, the outer flange 16A and the space 18A of the rocker arm.

The pivoting of the rocker arm is significant, as the deadbolting of the bolt can thus be disengaged and respectively engaged. For the purpose of deadbolting, the rocker arm 18 can comprise a rear arm 18B, which is arranged to face towards the deadbolting support 20 in the lock body, when the follower 4 is in its basic position. When one begins to turn the handle from the basic position towards the pivoted position, the rocker arm pivots and the rear arm no longer faces towards the deadbolting support 20. The bolt can, in this case, move inside the lock body. FIG. 3 shows such a situation. As can be seen from the figures, the bolt 2 also has a rear bar 19A, which is arranged to move linearly through the hole in the deadbolting support 20. The rear bar 19A is surrounded by a bolt spring 19, which is arranged to push the bolt outwards.

As it can be noticed from FIGS. 1 and 2 that the parts between the spindle shaft 3 of the handle and the bolt 2 (including the bolt and the shaft themselves) form a force transmission connection from the spindle shaft 3 of the handle to the bolt 2. Further, it can be seen that the force transmission connection comprises freedom of action among its parts. Freedom of action can, for example, be between the follower 4 and the force transmission linkage 5, and/or between the driver 7 and the follower 4. (See for example freedom of action between the clasp 5C and a cam 7B of the driver, or between a control surface 4B of the follower 4 and a surface 17A.) The freedom of action is useful when a position of a lock part is desired to detect in a reliable way. For example, the position of the handle may be desired to detect at the beginning of the turning of the handle, but before the opening of the dead locking of the bolt.

The rocker arm has a rocker surface 21, which is curved or comprises at least one curve. The rocker surface is arranged to abut the rear part 14A of the bolt. Thus, the rocker arm is able to pivot, when one begins to turn the handle from the basic position such that the spring 14 does not resist the turning or does not resist very much. The end of the rocker arm 18 on the rocker surface side can be wide in relation to the rest of the rocker arm. The wide end of the rocker arm 18 on the rocker surface side can also be used for other functions of the lock body. The wide end can comprise a control surface, for example, for the draw plate 8.

According to the example of the figures, the force transmission connection can comprise a lever 17, which is in a force transmission connection with the follower 4 and arranged into a force transmission connection with the rocker arm 18. A force transmission connection to the rocker arm can be created such that between the lever 17 and the rocker arm 18 is an arm 22, which is pivotally journaled 24, 25 from one end to the lever and from the other end to the arm. The journaling can be a pin, which is positioned into the holes of the arm 22 and the lever/rocker arm.

The follower 4 can be implemented such that it has a control surface 4B, and the lever 17 has a counter surface 17A, which abuts the control surface 4B. The control surface can be, for example, a roll journaled to the follower. The lever 17 comprises a pivoting axis 17C. It is practical to attach the pivoting axis to the body 1.

FIG. 4 shows a situation, in which the bolt is already partially moved inside the lock body. The spring 14 is biased such that it transfers a turning force applied to the spindle shaft of the handle to the bolt 2, more precisely, to the rear part 14A of the bolt. When the follower (and the handle) is pivoted further, the bolt finally moves inside the lock body. In this case, the end of the bolt is at least in the plane of the face plate 1A of the lock body in the manner of FIG. 5. The limiter part 50 limits the linear movement of the bolt deeper inside the lock body. The end of the bolt does not remain protruded outwards from the face plate. If, in the situation of FIG. 5, the follower still has travel distance remaining towards the pivoted position of the follower 4, the spring 14 begins to bias further, as the pivoting of the follower is continued towards the pivoted position. FIG. 6 shows such a situation, where the follower 4 is pivoted into the pivoted position and the spring 14 is further biased.

If the tolerance variation of the parts comprising the force transmission linkage and the follower is small, the spring 14 compresses relatively slightly. The more tolerance variation, the more the spring compresses. When the bolt has moved inside the lock body, it no longer moves any deeper due to the limiter part 50. It can be stated that, when the bolt abuts the limiter part 50, the more tolerance variation, the more will remain travel distance of the follower 4.

In other words, if the tolerance variation formed somewhere in the lock body unit during force transmission remains smaller, the spring is armed less and if tolerance variation during force transmission is greater, the spring is armed more. Due to the spring 14, 27, the tolerance requirements of the individual force transmission linkage and the follower parts can thus be loosened such that the level of quality of the lock body remains high. The bolt is always inside the lock body when turned inwards and it does not remain protruded. Production is also less expensive.

In light of the examples presented above, it is obvious that the embodiment according to the invention can be achieved by various solutions. The invention can thus be implemented by various embodiments within the scope of the independent claim.

The invention claimed is:

1. A lock body comprising:

a body;

a bolt, positioned in the body;

a spindle shaft of a handle, positioned in the body;

a driver positioned on the spindle shaft of the handle;

a follower positioned on the driver and pivotable with respect to the spindle shaft of the handle;

a force transmission linkage configured to transfer a turning force applied to the spindle shaft of the handle through the follower to the bolt to move the bolt linearly inside the lock body, said parts forming a force transmission connection from the spindle shaft of the handle to the bolt, the force transmission connection comprising freedom of action among its parts;

a biased spring configured to transfer said turning force to the bolt, through which the turning force applied to the spindle shaft of the handle is arranged to transfer to the bolt, and which spring is arranged to bias further if the bolt is moved inside the lock body, and there remains travel distance of the follower towards the pivoted position of the follower; and a limiter part configured to limit linear movement of the bolt inside the lock body without limiting the travel distance of the follower, wherein the bolt comprises a borehole, into which the spring is positioned, and which spring is a coil spring, and into which borehole is also partially positioned a pin surrounded by the spring, the first end of which pin has an outer flange, which pin is part of the force transmission linkage, and the outer flange of its first end is in connection with an end of the spring, and the another end of which spring abuts the rear part of the bolt.

2. The lock body according to claim 1, wherein the other end of the pin also has an outer flange, which is arranged into a force transmission connection with the rest of the force transmission linkage.

3. The lock body according to claim 2, wherein force transmission linkage comprises a rocker arm, which is in a force transmission connection with the outer flange of the other end of the pin, and which rocker arm has a space for the outer flange of the other end of the pin and is arranged to pivot, when the follower moves away from its basic position, and which rocker arm comprises a rear arm, which is arranged to abut a deadbolting support of the lock body, when the follower is in its basic position.

4. The lock body according to claim 3, wherein the rocker arm has a rocker surface, which is curved or comprises at least one curve, and which rocker surface is arranged to abut the rear part of the bolt.

5. The lock body according to claim 4, wherein the end of the rocker arm on the rocker surface side is wide in relation to the rest of the rocker arm.

6. The lock body according to claim 5, wherein the wide end of the rocker arm on the rocker surface side comprises a control surface for other functions of the lock body.

* * * * *